US010732560B2

(12) United States Patent
Suzuki

(10) Patent No.: US 10,732,560 B2
(45) Date of Patent: Aug. 4, 2020

(54) ELECTRICAL EQUIPMENT WITH VARISTOR MOUNTED

(71) Applicant: CANON KABUSHIKI KAISHA, Tokyo (JP)

(72) Inventor: Teruhiko Suzuki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/576,572

(22) Filed: Sep. 19, 2019

(65) Prior Publication Data

US 2020/0103805 A1 Apr. 2, 2020

(30) Foreign Application Priority Data

Sep. 27, 2018 (JP) ..... 2018-182032

(51) Int. Cl.
*G03G 15/00* (2006.01)
*G03G 15/20* (2006.01)

(52) U.S. Cl.
CPC ..... *G03G 15/80* (2013.01); *G03G 15/20* (2013.01); *G03G 15/5004* (2013.01)

(58) Field of Classification Search
CPC .... G03G 15/5004; G03G 15/20; G03G 15/80; H02H 1/0007
See application file for complete search history.

(56) References Cited

U.S. PATENT DOCUMENTS 5,559,578 A * 9/1996 Umeda ..... G03G 15/0266 399/161
2011/0076046 A1* 3/2011 Oh ..... B41J 29/13 399/88
2018/0103542 A1 4/2018 Shinotsuka
2018/0351213 A1* 12/2018 Sugisawa ..... H01M 10/44
2019/0207386 A1* 7/2019 Wang ..... H02H 9/005

FOREIGN PATENT DOCUMENTS

JP 2008-198969 8/2008

* cited by examiner

*Primary Examiner* — Joseph S Wong
(74) *Attorney, Agent, or Firm* — Venable LLP

(57) ABSTRACT

An electrical equipment including: an exterior having an opening portion; a circuit board provided to an inside of the exterior and configured to be connected to a commercial power source; a varistor mounted on the circuit board; and a line filter mounted on the circuit board, wherein the opening portion is formed in a predetermined direction orthogonal to electrodes of the varistor, and wherein the line filter is arranged between the varistor and the opening portion in the predetermined direction so as to prevent a range of a conical shape having a vertex at a center of the varistor, a height in the predetermined direction, and a predetermined solid angle θ from intersecting with the opening portion.

14 Claims, 7 Drawing Sheets

ELECTRICAL EQUIPMENT WITH VARISTOR MOUNTED

BACKGROUND OF THE DISCLOSURE

Field of the Disclosure

The present disclosure relates to an electrical equipment including a circuit board on which a varistor is mounted.

Description of the Related Art

On an electric circuit board for, for example, a low-pressure power source for an image forming apparatus, an electronic part having a surge absorption property, as represented by a varistor, is provided for the purpose of protecting a circuit on the electric circuit board from, for example, a lightning surge or an excessively high voltage surge. In a case in which an abnormal voltage is repeatedly applied, the above-mentioned electronic part provided for the purpose of surge absorption may gradually be degraded to cause a failure accompanied by scattering of the part. It is extremely rare that the degradation of the electronic part progresses to the worst level at which the failure accompanied by the scattering of the part may occur. However, the scattering of the part is required to be assumed. Meanwhile, heat-generating parts are concentrated around the electric circuit board to be used for the image forming apparatus, and thus an opening portion for cooling (louver) is formed in many cases. In an arrangement in which the opening portion for cooling and the varistor are provided adjacent to each other, fragments of the broken electronic part are required to be reliably prevented from passing through an air path to the outside of the image forming apparatus through the opening portion.

As a method of directly preventing the scattering of fragments of a varistor to the outside, there is disclosed in Japanese Patent Application Laid-Open No. 2008-198969 that the varistor is covered with a metal case having one open surface. Further, there is also conceivable a method of using a double-layer louver, whose positions of opening portions are shifted, or a louver having small holes. FIG. 7 is a sectional view of a related-art image forming apparatus 1100 configured to prevent the scattering of fragments of the varistor. The image forming apparatus 1100 includes an electric circuit board 3500, an air intake louver 111, a cooling fan 113, and an air exhaust louver 112. On the electric circuit board 3500, a varistor is mounted. The air intake louver 111 has a double-layered structure, and has opening portions, which are formed as air-intake opening portions so that positions of the opening portions are shifted between the layers. The air exhaust louver 112 has small holes as air-exhaust opening portions. The air intake louver 111 having the double-layered structure and the air exhaust louver 112 having the small holes prevent fragments of the broken varistor from scattering to the outside of the image forming apparatus 1100.

However, as disclosed in Japanese Patent Application Laid-Open No. 2008-198969, even when the varistor is covered with the metal case, an area exclusively occupied by the varistor on the electric circuit board is increased by an area of the metal case. Thus, a size of the electric circuit board itself is increased to hinder downsizing of the image forming apparatus. Further, when the air intake louver 111 having the double-layered structure and the air exhaust louver 112 having the small holes as illustrated in FIG. 7 are adopted, a ventilation characteristic is impaired, which is disadvantageous in cooling of the electric circuit board. In particular, when the cooling fan 113 is distant from the air intake louver 111 as illustrated in FIG. 7, the amount of air taken from the outside of the image forming apparatus 1100 into the image forming apparatus 1100 is reduced because of a low ventilation characteristic of the air intake louver 111. Thus, another cooling fan is required to be additionally provided or a large cooling fan is required to be provided, which may lead to increase in size of the image forming apparatus 1100.

SUMMARY OF THE DISCLOSURE

According to one embodiment of the present disclosure, there is provided an electrical equipment comprising:

an exterior having an opening portion;

a circuit board provided to an inside of the exterior and configured to be connected to a commercial power source;

a varistor mounted on the circuit board; and a line filter mounted on the circuit board, wherein the opening portion is formed in a predetermined direction orthogonal to electrodes of the varistor, and wherein the line filter is arranged between the varistor and the opening portion in the predetermined direction so as to prevent a range of a conical shape having a vertex at a center of the varistor, a height in the predetermined direction, and a predetermined solid angle θ from intersecting with the opening portion.

Further features of the present disclosure will become apparent from the following description of exemplary embodiments with reference to the attached drawings.

DESCRIPTION OF THE EMBODIMENTS

Modes for carrying out the present disclosure are described below with reference to the accompanying drawings.

First Embodiment (Image Forming Apparatus)

Now, a first embodiment is described for an image forming apparatus 100 as an example of electrical equipment. The image forming apparatus 100 forms an image on a recording medium (hereinafter referred to as "sheet") S.

Figure 1:
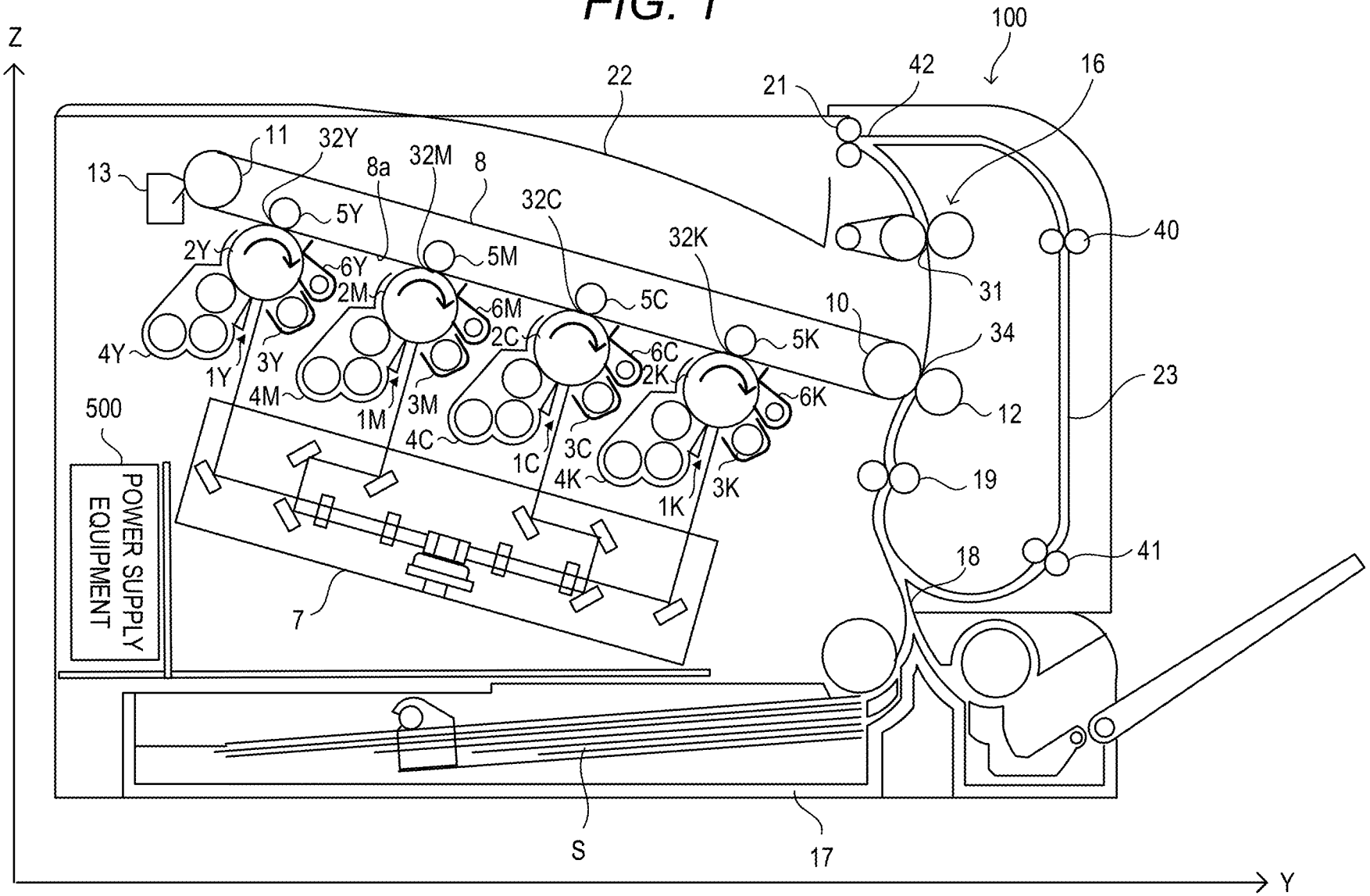
FIG. 1 is a sectional view of an image forming apparatus according to the present disclosure.

FIG. 1 is a sectional view of the image forming apparatus 100. In the following description, a vertical direction from a lower side to an upper side of the image forming apparatus 100 is defined as a Z direction, a horizontal direction from a left side to a right side of the image forming apparatus 100 is defined as a Y direction, and a horizontal direction from a front side to a rear side of the image forming apparatus 100 is defined as an X direction. The image forming apparatus 100 is a full-color printer configured to form a color image on the recording medium with an electrophotographic method. However, the image forming apparatus 100 is not limited to the full-color printer, and may be, for example, an electrophotographic copying machine, a color LED printer, a multifunctional printer (MFP), a facsimile machine, or a printing machine. The image forming apparatus 100 is not limited to a color image forming apparatus configured to form a color image, and may also be a monochromatic image forming apparatus configured to form a monochromatic image. An image forming method is not limited to the electrophotographic method, and may also be, for example, an electrostatic recording method or an ink jet method. The image forming apparatus 100 includes four image forming portions (image forming units), that is, an image forming portion 1Y configured to form a yellow image, an image forming portion 1M configured to form a magenta image, an image forming portion 1C configured to form a cyan image, and an image forming portion 1K configured to form a black image. Those four image forming portions 1Y, 1M, 1C, and 1K are arranged in one row at constant distances from each other.

Drum-type electrophotographic photosensitive members (hereinafter referred to as "photosensitive drums") 2Y, 2M, 2C, and 2K serving as image bearing members are installed in the image forming portions 1Y, 1M, 1C, and 1K, respectively. Around the photosensitive drum 2Y, a primary charger 3Y, a developing device 4Y, a transfer roller 5Y serving as transfer means, and a drum cleaner device 6Y are arranged. In the same manner, a primary charger 3M, a developing device 4M, a transfer roller 5M, and a drum cleaner device 6M are arranged around the photosensitive drum 2M, a primary charger 3C, a developing device 4C, a transfer roller 5C, and a drum cleaner device 6C are arranged around the photosensitive drum 2C, and a primary charger 3K, a developing device 4K, a transfer roller 5K, and a drum cleaner device 6K are arranged around the photosensitive drum 2K. A laser exposure device 7 is provided below between the primary chargers 3Y, 3M, 3C, and 3K and the developing devices 4Y, 4M, 4C, and 4K.

A yellow toner, a cyan toner, a magenta toner, and a black toner are received in the developing devices 4Y, 4M, 4C, and 4K, respectively. Each of the photosensitive drums 2Y, 2M, 2C, and 2K is a negatively-charged organic photoconductive member (OPC photosensitive member) including an organic photoconductive layer formed on a drum base made of aluminum, and is rotated by a drive device (not shown) in a direction indicated by the arrow (clockwise direction in FIG. 1) at a predetermined process speed. The primary chargers 3Y, 3M, 3C, and 3K serving as primary charging means uniformly charge surfaces of the photosensitive drums 2Y, 2M, 2C, and 2K to a predetermined potential having negative polarity with a charging bias applied by a charging bias power source (not shown). The developing devices 4Y, 4M, 4C, and 4K cause the toners of the respective colors to adhere on electrostatic latent images formed on the photosensitive drums 2Y, 2M, 2C, and 2K to develop (visualize) the electrostatic latent images as toner images, respectively. Transfer rollers 5Y, 5M, 5C, and 5K are arranged so as to be abuttable against the photosensitive drums 2Y, 2M, 2C, and 2K through an intermediate transfer belt 8 therebetween at primary transfer portions 32Y, 32M, 32C, and 32K, respectively. The drum cleaner devices 6Y, 6M, 6C, and 6K include cleaning blades for removing transfer residual toners remaining on the photosensitive drums 2Y, 2M, 2C, and 2K from the photosensitive drums 2Y, 2M, 2C, and 2K after primary transfer.

The intermediate transfer belt 8 is arranged on an upper surface side of the photosensitive drums 2Y, 2M, 2C, and 2K. The intermediate transfer belt 8 is provided in a tensioned manner between a secondary transfer opposed roller 10 and a tension roller 11. The secondary transfer opposed roller 10 is arranged on a secondary transfer portion 34 side, and is configured to apply a driving force to the intermediate transfer belt 8. The tension roller 11 is arranged on a side opposed to the secondary transfer opposed roller 10 through the primary transfer portions 32Y to 32K therebetween, and is configured to apply a tension to the intermediate transfer belt 8. The secondary transfer opposed roller 10 is arranged so as to be abuttable against a secondary transfer roller 12 through the intermediate transfer belt 8 therebetween at the secondary transfer portion 34. The intermediate transfer belt 8 is made of a dielectric resin such as polycarbonate, a polyethylene terephthalate resin film, or a polyvinylidene difluoride resin film. The intermediate transfer belt 8 is arranged so that a lower flat surface 8*a* serving as a primary transfer surface is inclined downward toward the secondary transfer portion 34 side. The lower flat surface 8*a* is arranged to be opposed to upper surfaces of the photosensitive drums 2Y, 2M, 2C, and 2K so as to be movable relative thereto, and is formed on a surface side opposed to the photosensitive drums 2.

The secondary transfer opposed roller 10 is arranged so as to be abuttable against the secondary transfer roller 12 through the intermediate transfer belt 8 therebetween at the secondary transfer portion 34. A belt cleaning device 13 configured to remove and collect a transfer residual toner remaining on a surface of the intermediate transfer belt 8 is arranged on an outer side of the intermediate transfer belt 8 formed in an endless shape so as to be located in the vicinity of the tension roller 11. A fixing device 16 is arranged in a longitudinal path configuration on a downstream side of the secondary transfer portion 34 in a conveying direction for the sheet S. The laser exposure device 7 includes a laser light source, a polygon mirror, and a reflecting mirror. The laser light source is configured to emit light corresponding to a time-series electric digital image signal of image information provided thereto. The laser light exposure device 7 exposes the photosensitive drums 2Y, 2M, 2C, and 2K to light to form the electrostatic latent images of the respective colors on the surfaces of the photosensitive drums 2Y, 2M, 2C, and 2K charged with the primary chargers 3Y, 3M, 3C, and 3K, respectively, in accordance with the image information.

Next, image forming operations performed by the image forming apparatus 100 are described. When an image formation start signal is issued, the photosensitive drums 2Y, 2M. 2C, and 2K, which are rotated at a predetermined process speed, are uniformly charged to the negative polarity with the primary chargers 3Y, 3M, 3C, and 3K, respectively. Then, the laser exposure device 7 emits laser light from laser emitting elements in accordance with externally input color-separated image signals. The laser light passes through the polygon mirror and the reflecting mirror to form the electrostatic images of the respective colors on the photosensitive drums 2Y, 2M, 2C, and 2K, respectively.

Then, first, the yellow toner is caused to adhere to the electrostatic latent image formed on the photosensitive drum 2Y by the developing device 4Y to which a development bias of the same polarity as the charging polarity (negative polarity) for the photosensitive drum 2Y is applied, thereby visualizing the electrostatic latent image as a toner image. The yellow toner image is transferred onto the rotating intermediate transfer belt 8 by the transfer roller 5Y to which a primary transfer bias (of the polarity (positive polarity) opposite to the polarity of the toner) is applied, at the primary transfer portion 32Y between the photosensitive drum 2Y and the transfer roller 5Y.

The intermediate transfer belt 8, onto which the yellow toner image has been transferred, is moved to the image forming portion 1M. Then, even in the image forming portion 1M, a magenta toner image formed on the photosensitive drum 2M is transferred in the same manner at the primary transfer portion 32M so as to be superimposed on the yellow toner image on the intermediate transfer belt 8. Subsequently, a cyan toner image formed on the photosensitive drum 2C in the image forming portion 1C and a black toner image formed on the photosensitive drum 2K in the image forming portion 1K are sequentially superimposed on the yellow toner image and the magenta toner image, which have been transferred onto the intermediate transfer belt 8 in a superimposed manner, at the primary transfer portion 32C and the primary transfer portion 32K, respectively. In this manner, a full-color toner image is formed on the intermediate transfer belt 8. At this time, the transfer residual toners remaining on the photosensitive drums 2Y, 2M, 2C, and 2K are scraped off and collected by the cleaner blades included in the drum cleaner devices 6Y, 6M, 6C, and 6K, respectively.

The sheet (paper sheet) S is conveyed from a sheet feeding cassette 17 through a conveyance path 18 to registration rollers 19. The sheet S is conveyed by the registration rollers 19 to the secondary transfer portion 34 between the secondary transfer opposed roller 10 and the secondary transfer roller 12 so as to match the timing at which a leading edge of the full-color toner image on the intermediate transfer belt 8 is moved to the secondary transfer portion 34 between the secondary transfer opposed roller 10 and the secondary transfer roller 12. The full-color toner image on the intermediate transfer belt 8 is transferred at a time onto the sheet S, which has been conveyed to the secondary transfer portion 34, by the secondary transfer roller 12 to which a secondary transfer bias (of the polarity (positive polarity) opposite to the polarity of the toner) is applied.

After the sheet S on which the full-color toner image is formed is conveyed to the fixing device 16 and the full-color toner image is heated and pressurized to be thermally fixed onto a surface of the sheet S, the sheet S is discharged by delivery rollers 21 onto a delivery tray 22, which is located to an upper surface of a main body. Then, a series of the image forming operations is terminated. A secondary transfer residual toner remaining on the intermediate transfer belt 8 is removed and collected by the belt cleaning device 13. The above-mentioned operations are the image forming operations at the time of simplex image formation.

Subsequently, double-sided image forming operations performed by the image forming apparatus 100 are described. The double-sided image forming operations are the same as the simplex image forming operations until the sheet S having one surface on which the image is formed is conveyed to the fixing device 16. After the full-color toner image is heated and pressurized so as to be thermally fixed onto the surface of the sheet S, the rotation of the delivery rollers 21 is stopped under a state in which most part of the sheet S is delivered by the delivery rollers 21 onto the delivery tray 22, which is located on the upper surface of the main body. At this time, the sheet S is stopped so that a trailing edge of the sheet S reaches a reversal enabled position 42.

Subsequently, the delivery rollers 21 are reversely rotated in a rotating direction opposite to a normal rotating direction to thereby convey the sheet S to a double-sided path 23 to which double-sided printing rollers 40 and 41 are provided. Through the reverse rotation of the delivery rollers 21, the sheet S is conveyed to the double-sided printing rollers 40 with the trailing edge of the sheet S, which is located at the reversal enabled position 42, now being conveyed as a leading edge. Thereafter, the sheet S is conveyed by the double-sided printing rollers 40 to the double-sided printing rollers 41. The sheet S is conveyed by the double-sided printing rollers 40 and 41 toward the registration rollers 19. Meanwhile, the image formation start signal is generated, and the leading edge of the full-color toner image on the intermediate transfer belt 8 is moved to the secondary transfer portion 34 between the secondary transfer opposed roller 10 and the secondary transfer roller 12 in the same manner as in the simplex image formation. The registration rollers 19 convey the sheet S to the secondary transfer portion 34 so as to match the timing at which the leading edge of the full-color toner image on the intermediate transfer belt 8 is moved to the secondary transfer portion 34. After the leading edge of the toner image and the leading edge of the sheet S are matched with each other at the secondary transfer portion 34, the toner image is transferred onto the sheet S. Then, the toner image is fixed onto the sheet S by the fixing device 16 in the same manner as in the simplex image forming operation. The sheet S having both surfaces on which the images are formed is delivered by the delivery rollers 21 onto the delivery tray 22. Then, a series of the double-sided image forming operations is terminated.

(Basic Controller)

Figure 2:
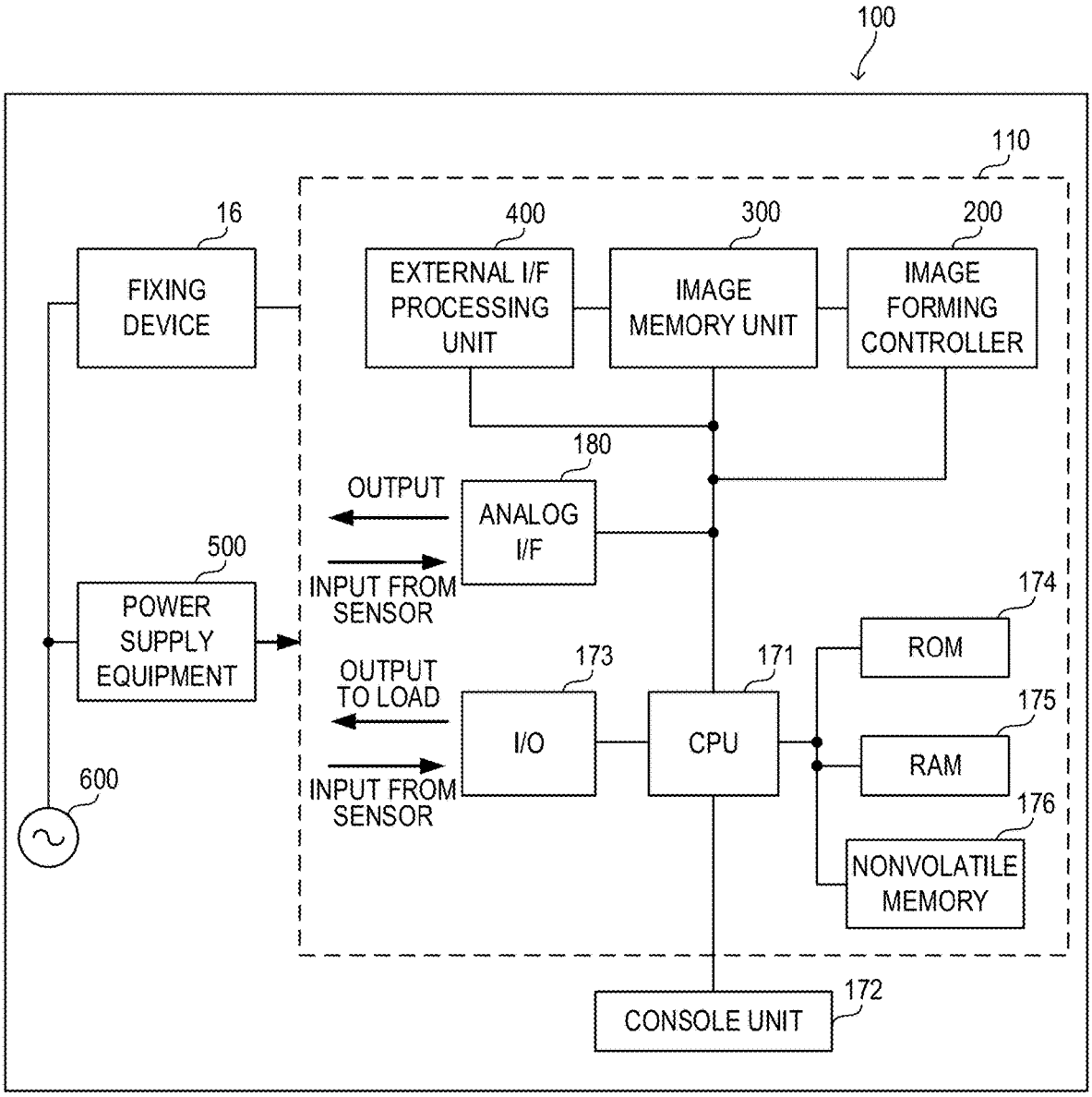
FIG. 2 is a block diagram of a control system for the image forming apparatus according to the present disclosure.

FIG. 2 is a block diagram of a control system of the image forming apparatus 100. The image forming apparatus 100 includes a basic controller 110 including a CPU 171. The CPU 171 is connected to a ROM 174, a RAM 175, a nonvolatile memory 176, an I/O port 173, and an analog OF 180 through address buses and data buses. The ROM 174 stores control programs. The RAM 175 stores data that is required to perform control. The nonvolatile memory 176 can store data even after power supply equipment 500 of the image forming apparatus 100 is turned off.

The power supply equipment 500 includes a power supply portion for control (not shown) and a power supply portion for load (not shown). The power supply portion for control (not shown) supplies DC power for control at a relatively low voltage level (generally in a range of from 3.3 V to 5 V) to the CPU 171 and the analog I/F 180 of the basic controller 110, and a sensor (not shown) configured to detect a position of the sheet S. The power supply portion for load (not shown) supplies DC power for load at a relatively high voltage level (generally 24 V) to drive loads (not shown) such as a motor and a clutch. A positional relationship among mounted parts of the power supply equipment 500 and a cooling fan 540 is described later with reference to FIG. 4A and FIG. 4B.

The I/O port 173 is connected to the drive loads (not shown) such as the motor and the clutch, the sensor (not shown) configured to detect the position of the sheet S, and the fixing device 16. The CPU 171 sequentially controls inputs and outputs via the I/O port 173 in accordance with the control programs stored in the ROM 174 to execute the image forming operations. The CPU 171 is electrically connected to a console unit 172. The CPU 171 controls display means and key input means of the console unit 172. An operator can instruct the CPU 171 to switch an image forming operation mode and switch a display screen of the display means through the key input means. The CPU 171 causes the display means to display a state of the image forming apparatus 100 and a value of the image forming operation mode set through the key input means. The CPU 171 is electrically connected to an external I/F processing unit 400, an image memory unit 300, and an image forming controller 200. The external I/F processing unit 400 transmits and receives image data and processing data between external equipment such as a PC and the CPU 171. The image memory unit 300 performs decompression processing for an image and temporary storage processing for the image data. The image forming controller 200 processes line image data transferred from the image memory unit 300. The laser exposure device 7 exposes the photosensitive drums 2 to light in accordance with the image data processed by the image forming controller 200. The base controller 110 is electrically connected to the fixing device 16.

(Varistor)

Figure 3A:
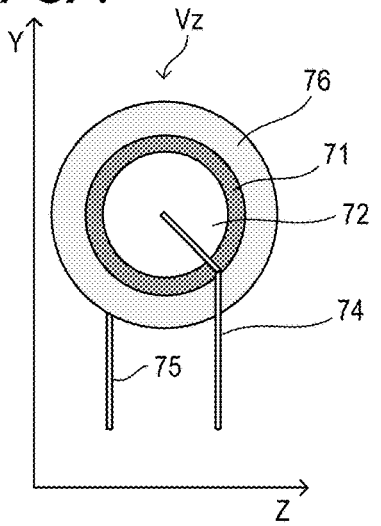
FIG. 3A, FIG. 3B, FIG. 3C, FIG. 3D, and FIG. 3E are explanatory views of a varistor.
Figure 3B:
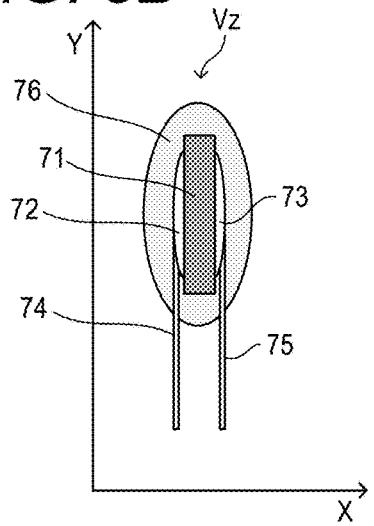

The power supply equipment 500 includes a varistor Vz having a disc shape. The varistor Vz is an electronic part having a surge absorption characteristic for protecting the power supply equipment 500 and the basic controller 110 from an unexpected high voltage such as a lightning surge or an excessively high voltage surge. FIG. 3A, FIG. 3B, FIG. 3C, FIG. 3D, and FIG. 3E are explanatory views of the varistor Vz. FIG. 3A is a sectional view of the varistor Vz on a plane parallel to a YZ plane. FIG. 3B is a sectional view of the varistor Vz on a plane parallel to a YX plane. The varistor Vz includes a semiconductor ceramic 71, electrodes 72 and 73, lead wires 74 and 75, and an exterior 76. The semiconductor ceramic 71 has a non-linear resistance characteristic. The two electrodes 72 and 73 are provided so as to sandwich the semiconductor ceramic 71 therebetween. The lead wires 74 and 75 are soldered to the two electrodes 72 and 73, respectively. The exterior 76 covers the semiconductor ceramic 71 and the electrodes 72 and 73. The varistor Vz has such a property that an electric resistance is high when a voltage across the lead wires 74 and 75 is low and the electric resistance is drastically decreased when the voltage is equal to or higher than a given value.

Figure 3C:
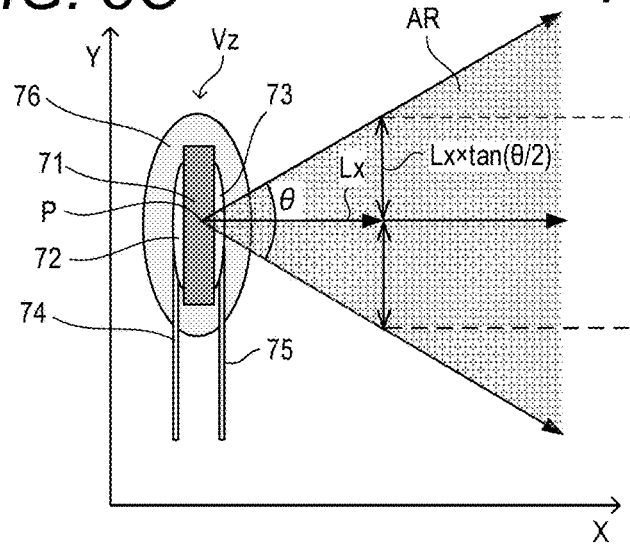
Figure 3D:
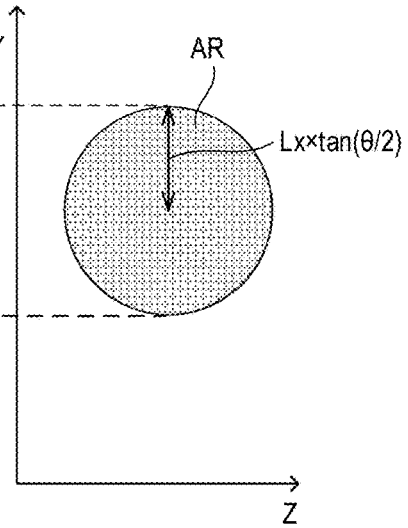
Figure 3E:
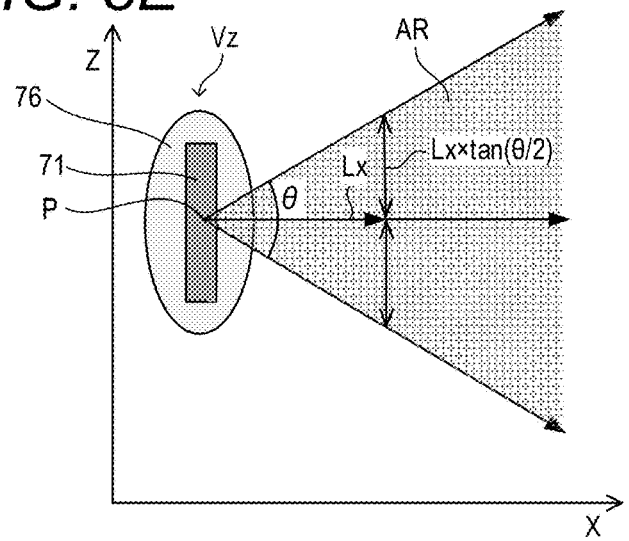

When the varistor Vz fails, a part such as the semiconductor ceramic 71, the electrode 72 or 73, the lead wire (terminal) 74 or 75, or the exterior 76 may be scattered in some cases. FIG. 3C, FIG. 3D, and FIG. 3E are explanatory views for illustrating a direction of scattering of the part in case of failure accompanied by the scattering of the part of the varistor Vz and a range AR of scattering. FIG. 3C is a sectional view of the varistor Vz on the plane parallel to the YX plane. FIG. 3D is a view for illustrating the range AR having a circular shape on the plane parallel to the YZ plane, which is taken at a distance Lx from the varistor Vz. FIG. 3E is a sectional view of the varistor Vz on the plane parallel to an XZ plane. In this embodiment, the varistor Vz is arranged so that surfaces of the electrodes 72 and 73, each having a circular shape, are arranged in parallel to the YZ plane, and the lead wires 74 and 75 extend in parallel to a Y-axis direction.

As described above, the varistor Vz may cause a failure accompanied by the scattering of the part in such rare cases that an abnormal voltage is repeatedly applied. On the YX plane illustrated in FIG. 3C, it is experimentally known that fragments of the varistor Vz are scattered to fall within the range AR having an approximate center of the varistor Vz as a vertex P, a height in an X-axis direction orthogonal to the electrodes (electrode surfaces) 72 and 73, each having the circular shape, and a solid angle θ. The center of the varistor Vz corresponds to the center of the varistor Vz without the lead wires 74 and 75. Even on the XZ plane illustrated in FIG. 3E, it is experimentally known that fragments of the varistor Vz are scattered to fall within the range AR having the approximate center of the varistor Vz as the vertex P, the height in the X-axis direction orthogonal to the electrodes 72 and 73, each having the circular shape, and the solid angle θ. Specifically, the fragments are scattered to fall within the range AR of a conical space, which has the approximate center of the varistor Vz as the vertex P, the height in the X-axis direction, and the solid angle θ. Hence, for example, as illustrated in FIG. 3D, on the plane at the distance Lx from the varistor Vz, which is parallel to the YZ plane, the fragments are scattered to fall within the range AR of a circle having a radius of $Lx \times \tan(\theta/2)$.

Figure 4A:
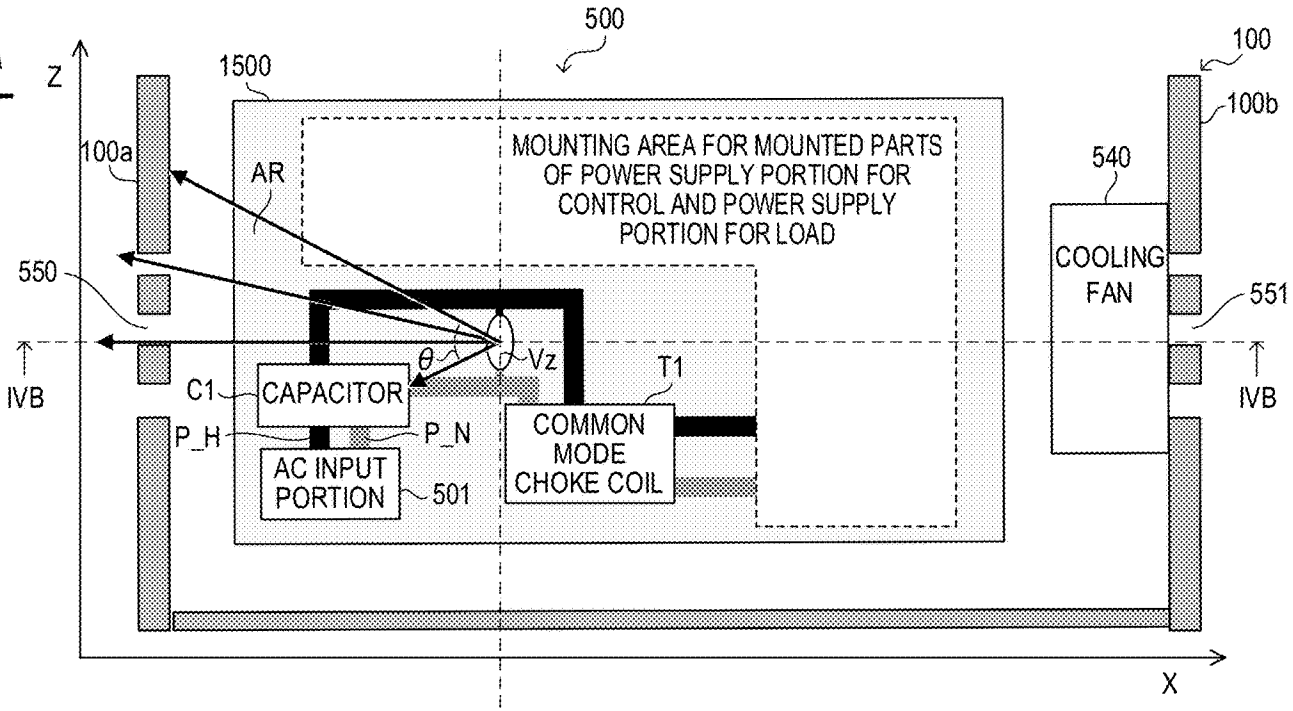
FIG. 4A PRIOR ART
FIG. 4A and FIG. 4B are sectional views of a related-art printed circuit board included in an image forming apparatus.
Figure 4B:
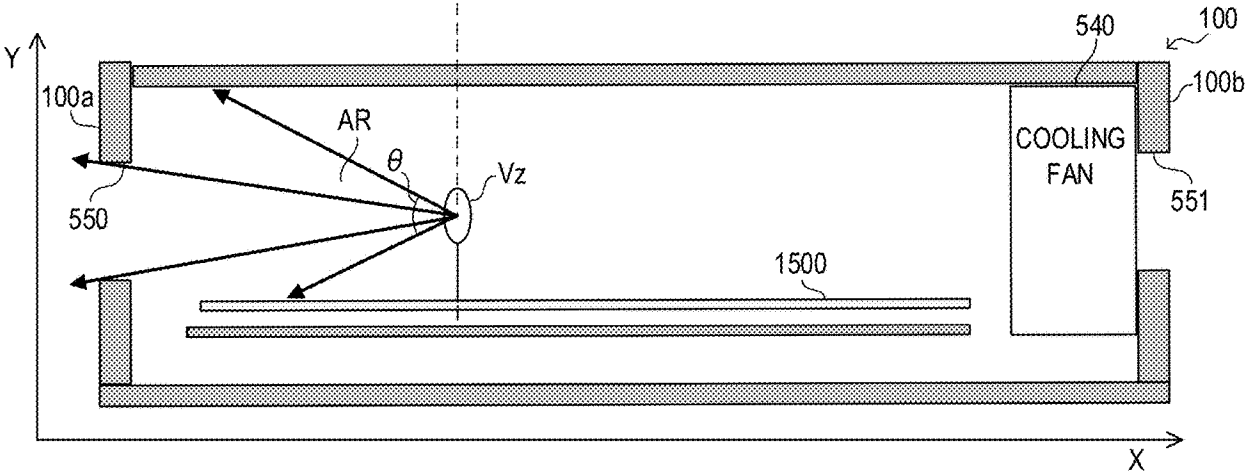
FIG. 4B PRIOR ART

A related-art electric circuit board (hereinafter referred to as "printed circuit board") 1500 included in the power supply equipment 500 is described. FIG. 4A and FIG. 4B are sectional views of the related-art printed circuit board 1500 included in the image forming apparatus 100. FIG. 4A is a sectional view on a plane parallel to the XZ plane, which is for illustrating a positional relationship between mounted parts on part of the related-art printed circuit board 1500 arranged on the left side of the laser exposure device 7 in the Y direction and the cooling fan 540 serving as a cooling part in the image forming apparatus 100 of FIG. 1. FIG. 4B is a sectional view of the related-art printed circuit board 1500 included in the image forming apparatus 100, which is taken along the line IVB-IVB of FIG. 4A.

The printed circuit board 1500 is a power supply circuit board to be connected to a commercial power source 600 (FIG. 2) through an AC input portion 501 serving as a general connector. On the printed circuit board 1500, a pattern P_H and a pattern P_N, which are connected to line filters of various kinds, are formed. The line filters include an across-the-line capacitor C1 and a common mode choke coil T1. A hot (H) terminal (live (L) terminal; first terminal) of the commercial power source 600 is connected to the pattern P_H (second pattern) of the printed circuit board through the AC input portion 501. A neutral (N) terminal (cold terminal; second terminal) of the commercial power source 600 is connected to the pattern P_N (second pattern) of the printed circuit board through the AC input portion 501. The across-the-line capacitor C1, the varistor Vz, and the common mode choke coil T1 are electrically connected to the pattern P_H and the pattern P_N in the stated order in a downward direction from the AC input portion 501. Each of the across-the-line capacitor C1, the varistor Vz, and the common mode choke coil T1 is connected between the pattern P_H connected to the H terminal of the commercial power source 600 and the pattern P_N connected to the N terminal of the commercial power source 600. On the downstream side of the common mode choke coil T1, the patterns P_H and P_N are electrically connected to the mounted parts of the power supply portion for control and the power supply portion for load.

The across-the-line capacitor C1 is a line filter, which is mounted so as to absorb normal mode noise to the printed circuit board 1500. The across-the-line capacitor C1 is required to have a withstand voltage between the H terminal and the N terminal of the commercial power source 600, and hence is generally a relatively large rectangular parallelepiped having three sides, each being about 3 cm long. The varistor Vz is a protective element to be mounted so as to absorb a voltage applied to the printed circuit board 1500 when an excessively high voltage such as lightning is applied between the H terminal and the N terminal of the commercial power source 600. The varistor Vz is generally a disc-shaped part having a diameter of about 1 cm. The common mode choke coil T1 is a line filter to be mounted so as to absorb common mode noise to the printed circuit board 1500. The common mode choke coil T1 has a large core line for a drive current and an increased number of turns for noise absorption, and hence is generally a relatively large columnar part having a diameter of about 3 cm. When the varistor Vz is arranged downstream of the common mode choke coil T1 and an excessively high voltage is applied to the commercial power source 600, the voltage is further increased due to an inductance component of the common mode choke coil T1 to render the varistor Vz breakable. Thus, the above-mentioned positional relationship is common. For the above-mentioned reason, the varistor Vz is mounted in the vicinity of the AC input portion 501.

Further, a large number of heat generating parts are provided on the printed circuit board 1500. For example, the common mode choke coil T1 generates heat with wattage determined by the expression: resistive component×drive current. The power supply portion for control and the power supply portion for load, which are AC/DC switching power sources, generate heat due to a switching loss. Thus, the cooling fan 540 is arranged in the vicinity of the printed circuit board 1500 so as to cool the printed circuit board 1500. The cooling fan 540 is arranged on the rear side of the printed circuit board 1500 in the X-axis direction. The cooling fan 540 discharges air in the image forming apparatus 100, which has been heated by heat from the printed circuit board 1500, to the outside of the image forming apparatus 100 through an opening portion 551 formed in an exterior 100*b* on the rear side of the image forming apparatus 100. The opening portion 551 is an air path for allowing the air to flow between an inside and an outside of the exterior 100*b*. At least one opening portion 550 is formed in an exterior 100*a* on a front side of the image forming apparatus 100 so as to be located on a front side of the printed circuit board 1500 in the X-axis direction orthogonal to the electrodes 72 and 73 of the varistor Vz. The opening portion 550 is an air path for allowing air to flow between an inside and an outside of the exterior 100*a*. While the cooling fan 540 is being rotated, an outside air of the image forming apparatus 100 is taken into the image forming apparatus 100 through the opening portion 550. In this manner, while the cooling fan 540 is being rotated, the outside air of the image forming apparatus 100 flows through the opening portion 550, above the printed circuit board 1500, and through the cooling fan 540 and the opening portion 551 to cool the power supply equipment 500.

As described above, in general, the opening portion 550 is formed in the vicinity of the printed circuit board 1500 as the air path for cooling. Specifically, the opening portion 550 is arranged in the vicinity of the varistor Vz in many cases. When a failure of the varistor Vz, which is accompanied by the scattering of the part, occurs, the fragments are scattered within a range of the solid angle θ, which has the center of the varistor Vz as the vertex P, in a negative X-axis direction (predetermined direction) as illustrated in FIG. 3C, FIG. 3D, and FIG. 3E. The fragments of the varistor Vz are scattered in directions indicated by the arrows in FIG. 4A and FIG. 4B. The range AR having the conical shape, in which the fragments of the varistor Vz may be scattered, intersects with the opening portion 550. Thus, there is a fear in that, depending on a size of the scattered fragment, the fragment may be scattered outside of the image forming apparatus 100 through the opening portion 550.

Figures 5A, 5B, 5C:
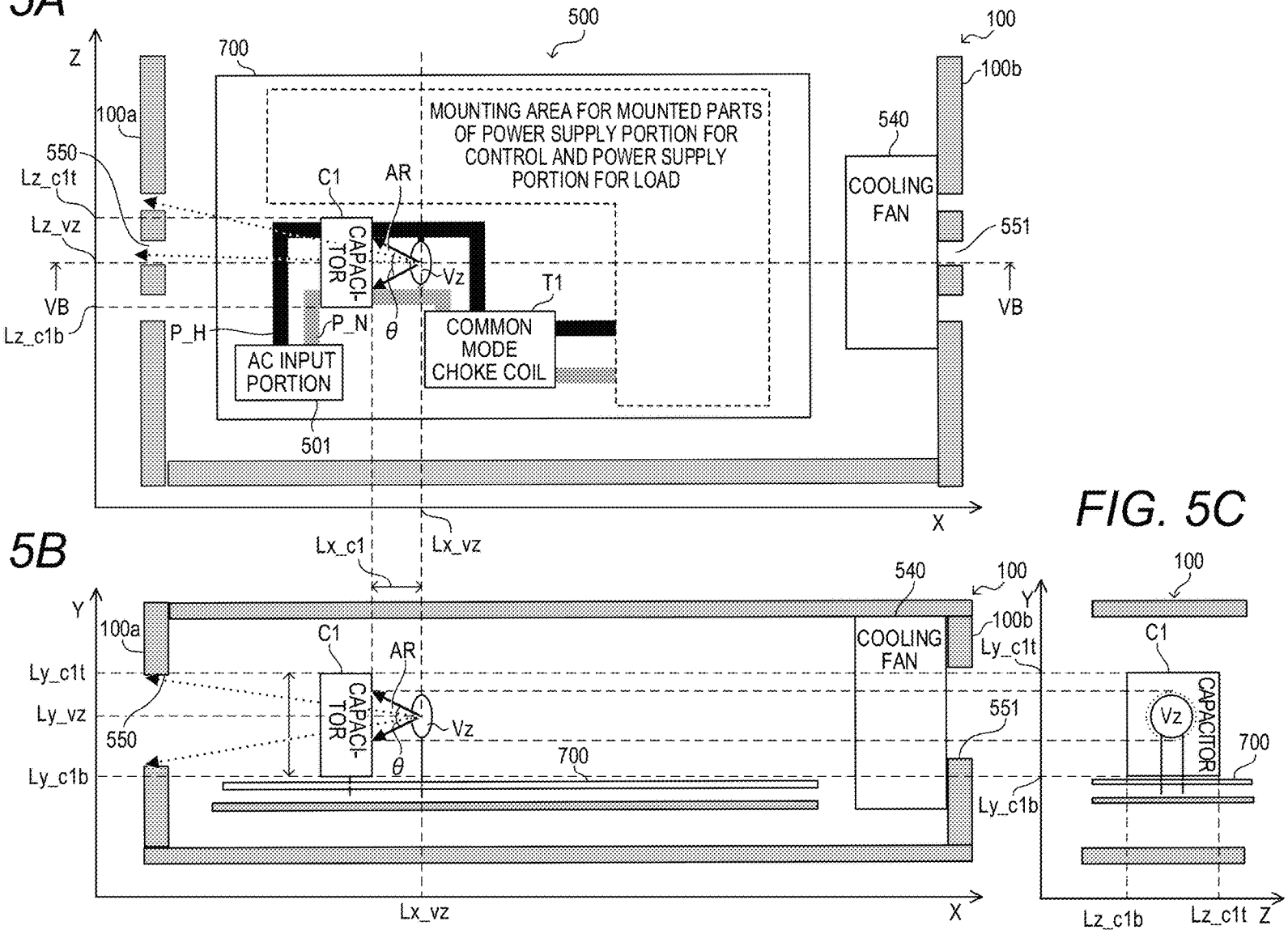
FIG. 5A, FIG. 5B, and FIG. 5C are sectional views of a printed circuit board included in the image forming apparatus according to a first embodiment.

An electric circuit board (hereinafter referred to as "printed circuit board") 700 provided in the power supply equipment 500 of the first embodiment is now described. FIG. 5A, FIG. 5B, and FIG. 5C are sectional views of the printed circuit board 700 provided in the image forming apparatus 100 according to the first embodiment. FIG. 5A is a sectional view on a plane parallel to the XZ plane, which is for illustrating a positional relationship between the mounted parts on part of the printed circuit board 700 of the first embodiment, which is arranged on the left side of the laser exposure device 7 in the Y direction, and the cooling fan 540 serving as the cooling part, in the image forming apparatus 100 of FIG. 1. FIG. 5B is a sectional view of the printed circuit board 700 included in the image forming apparatus 100 according to the first embodiment, which is taken along the line VB-VB of FIG. 5A. FIG. 5C is a sectional view of the printed circuit board 700 of the first embodiment, which is taken on a plane parallel to the YZ plane. The printed circuit board 700 is a power supply circuit board, to be connected to the commercial power source 600 (FIG. 2) through the AC input portion 501, which is configured to supply power to loads of the image forming apparatus 100. Electrical connection of the printed circuit board 700 according to the first embodiment is the same as that of the related-art printed circuit board 1500 illustrated in FIG. 4A and FIG. 4B. However, a position of the across-the-line capacitor C1 on the printed circuit board 600 is different. More specifically, as illustrated in FIG. 5A, the across-the-line capacitor C1 is arranged on the line perpendicular to the electrode of the varistor Vz which passes through the approximate center of the varistor Vz so as to be located on the left side of the varistor Vz in the X-axis direction. The across-the-line capacitor C1 is arranged between the varistor Vz and the opening portion 550 so as to prevent the range AR having the conical shape, in which the fragments of the varistor may be scattered, from intersecting with the opening portion 550.

A positional relationship between the across-the line capacitor C1 and the varistor Vz is now described. Coordinates of the center of the varistor Vz on the X axis, the Y axis, and the Z axis are represented as Lx_vz, Ly_vz, and Lz_vz. A distance between the across-the-line capacitor C1 and the center of the varistor Vz is represented as Lx_c1. A coordinate of a right end of the across-the-line capacitor C1 in the Y-axis direction (upper end of the across-the-line capacitor C1 on the Y coordinate) is represented as Ly_c1*t*, and a coordinate of a left end of the across-the-line capacitor C1 in the Y-axis direction (lower end of the across-the-line capacitor C1 on the Y coordinate) is represented as Ly_c1*b*. A coordinate of an upper end of the across-the-line capacitor C1 in the Z-axis direction (upper end of the across-the-line capacitor C1 on the Z coordinate) is represented as Lz_c1*t*, and a coordinate of a lower end of the across-the-line capacitor C1 in the Z-axis direction (lower end of the across-the-line capacitor C1 on the Z coordinate) is represented as Lz_c1*b*. The across-the-line capacitor C1 is set as a selected part. The coordinate Ly_c1*t* of the right end, the coordinate Ly_c1*b* of the left end, and the coordinate Lz_c1*t* of the upper end, and the coordinate Lz_c1*b* of the lower end of the across-the-line capacitor C1 represent a size of the selected part. For example, the size of the selected part, the Y-axis coordinate Ly_vz and the Z-axis coordinate Lz_vz of the center of the varistor Vz, and the distance Lx_c1 between the across-the-line capacitor C1 and the center of the varistor Vz are set so as to satisfy the following relationships.

$$Ly_vz+Lx_c1\times\tan(\theta/2)<Ly_c1t$$

$$Ly_vz-Lx_c1\times\tan(\theta/2)>Ly_c1b$$

$$Lz_vz+Lx_c1\times\tan(\theta/2)<Lz_c1t$$

$$Lz_vz-Lx_c1\times\tan(\theta/2)>Lz_c1b$$

When the above-mentioned relationships are satisfied, the across-the-line capacitor C1 can cover a whole area of a base of the range AR having the conical shape with the solid angle θ in which the fragments of the varistor Vz may be scattered. The solid angle θ at which the fragments of the varistor Vz may be scattered differs depending on a withstand voltage or a manufacturer, and is experimentally up to about 120 degrees. It is preferred that the predetermined solid angle θ be set to 120 degrees or smaller.

Examples of the size of the selected part and the positional relationship are described below. The example of the size of the across-the-line capacitor C1 is as follows.

$$Ly_c1t-Ly_c1b=20\text{ mm}$$

$$Lz_c1t-Lz_c1b=25\text{ mm}$$

The positional relationship between the visitor Vz and the across-the-line capacitor C1 is as follows.

$$Lx_c1=5\text{ mm}$$

$$Ly_vz=Ly_c1b+10\text{ mm}$$

$$Lz_vz=Lz_c1b+12.5\text{ mm}$$

In the first embodiment, the whole area of the base of the range AR having the conical shape with the solid angle θ in which the fragments of the varistor Vz may be scattered in the negative X-axis direction (hereinafter referred to as "whole surface of the solid angle θ") is covered with the across-the-line capacitor C1. However, in a case where the varistor Vz is arranged so as to prevent the range AR having the conical shape, in which the fragments of the varistor Vz may be scattered, from intersecting with the opening portion 550, the whole surface of the solid angle θ at which the fragments of the varistor Vz may be scattered is not always required to be covered with the across-the-line capacitor C1. The across-the-line capacitor C1 is only required to cover part of the range AR having the conical shape and intersecting with the opening portion 550, in which the fragments of the varistor Vz may be scattered. However, there is also a possibility of scattering of the fragments of the varistor Vz through an extremely small gap that is unintentionally formed at a joint portion between the exteriors of the image forming apparatus 100. In consideration of the possibility described above, it is desired to cover the whole surface of the solid angle θ with the across-the-line capacitor C1 to limit the range AR in which the fragments of the varistor Vz may be scattered.

According to the first embodiment, when the varistor Vz fails, the scattering of fragments of the varistor Vz to the outside through the opening portion 550 of the image forming apparatus 100 can be prevented without increasing a size of the image forming apparatus 100.

Second Embodiment

Figures 6A, 6B, 6C:
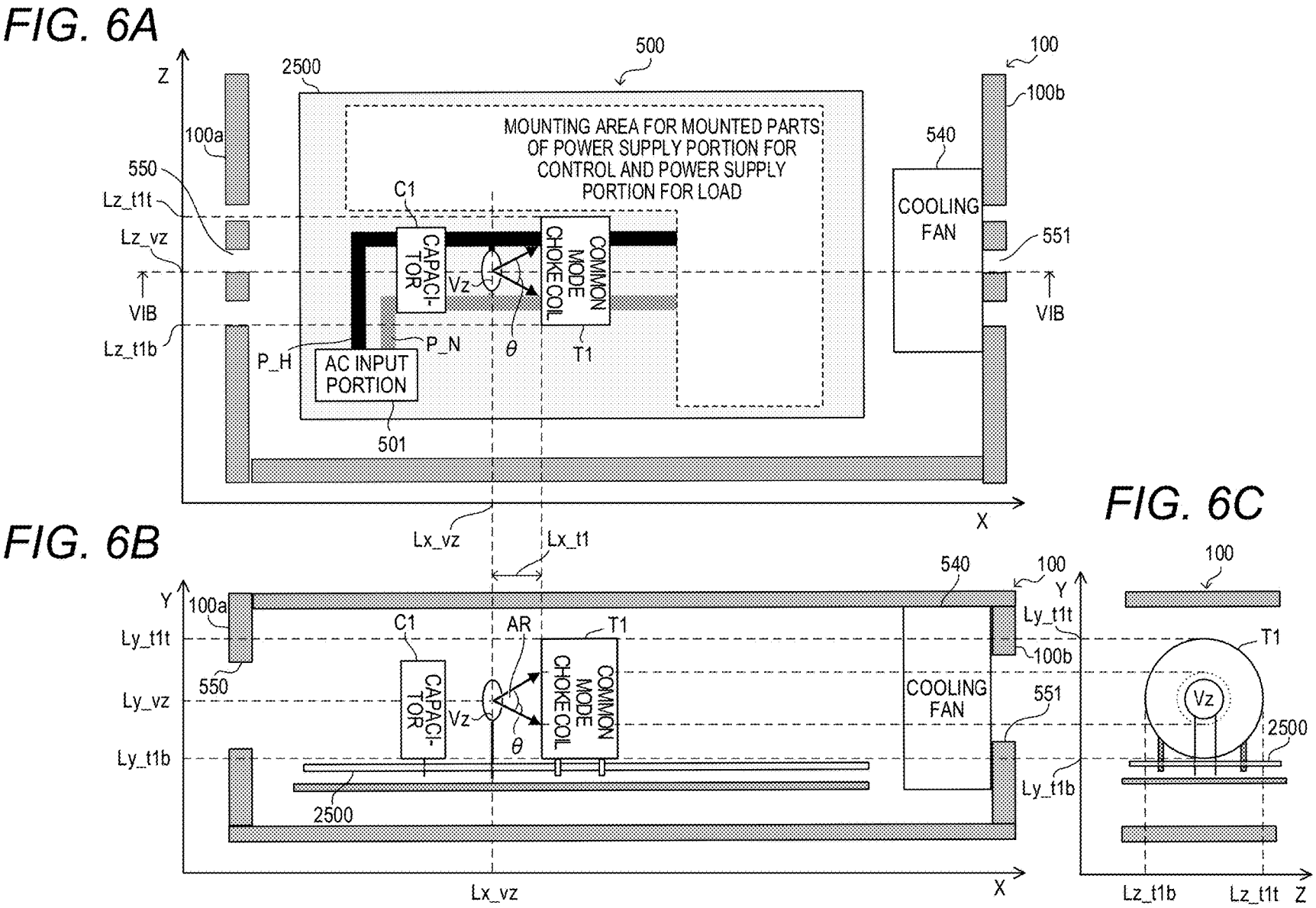
FIG. 6A, FIG. 6B, and FIG. 6C are sectional views of a printed circuit board included in an image forming apparatus according to a second embodiment.
Figure 7:
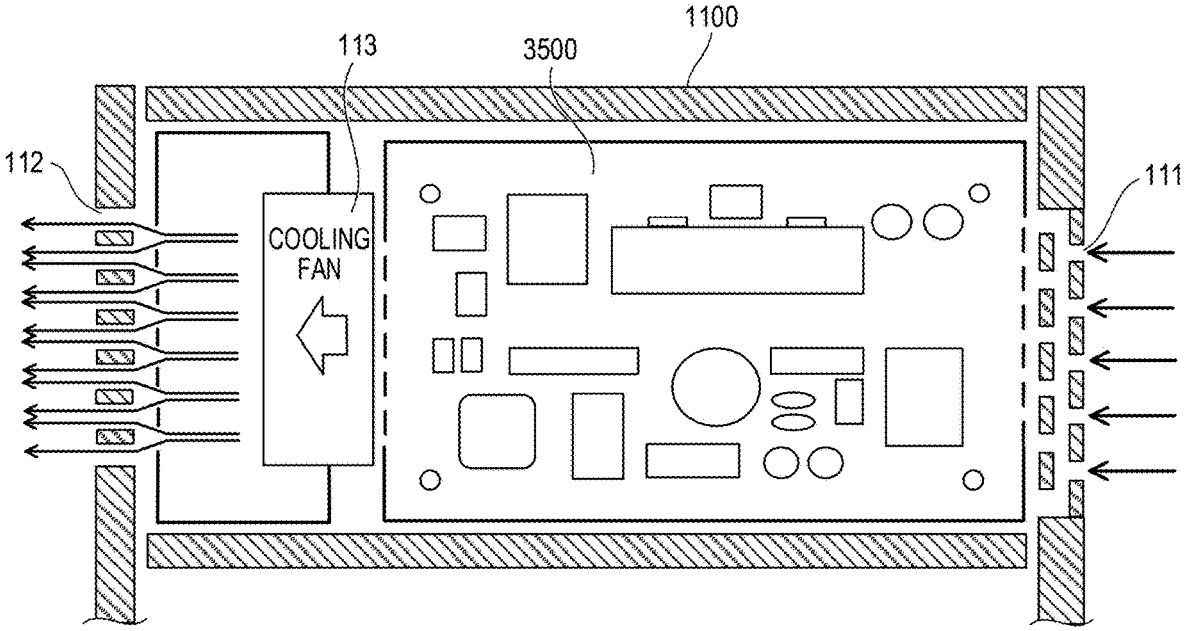
FIG. 7 PRIOR ART
FIG. 7 is a sectional view of a related-art image forming apparatus for preventing scattering of fragments of a varistor.

Now, a second embodiment is described with reference to FIG. 6A, FIG. 6B, and FIG. 6C. In the second embodiment, the same structures as those of the first embodiment are denoted by the same reference symbols, and description thereof is herein omitted. The image forming apparatus 100 of the second embodiment is the same as in the first embodiment, and thus the explanation thereof is omitted. An electric circuit board (hereinafter referred to as "printed circuit board") 2500 of the second embodiment, which is included in the power supply equipment 500, is now described. The printed circuit board 2500 of the second embodiment differs from the printed circuit board 700 of the first embodiment in the arrangement of the common mode choke coil T1. Other than that, the printed circuit board 2500 is the same as the printed circuit board 700 according to the first embodiment. FIG. 6A, FIG. 6B, and FIG. 6C are sectional views of the printed circuit board 2500 provided in the image forming apparatus 100 according to the second embodiment. FIG. 6A is a sectional view on a plane parallel to the XZ plane, which is for illustrating a positional relationship between the mounted parts on part of the printed circuit board 2500 of the second embodiment, which is arranged on the left side of the laser exposure device 7 in the Y direction, and the cooling fan 540 serving as the cooling part, in the image forming apparatus 100 of FIG. 1. FIG. 6B is a sectional view of the printed circuit board 2500 included in the image forming apparatus 100 according to the second embodiment, which is taken along the line VIB-VIB of FIG. 6A. FIG. 6C is a sectional view of the printed circuit board 2500 of the second embodiment, which is taken on a plane parallel to the YZ plane.

The printed circuit board 2500 is connectable to the commercial power source 600 (FIG. 2) through the AC input portion 501. Electrical connection of the printed circuit board 2500 according to the first embodiment is the same as that of the printed circuit board 700 illustrated in FIG. 5A, FIG. 5B, and FIG. 5C. However, a position of the common mode choke coil T1 is different. More specifically, as illustrated in FIG. 6A, the common mode choke coil T1 is arranged on the line perpendicular to the electrode of the varistor Vz which passes through the approximate center of the varistor Vz, so as to be located on the right side of the varistor Vz in the X-axis direction. The common mode choke coil T1 is arranged on the side opposite to the opening portion 550 with respect to the varistor Vz. When the varistor Vz fails, the fragments of the varistor Vz may be scattered in a positive X-axis direction (direction opposite to the predetermined direction) orthogonal to the electrodes 72 and 73 of the varistor Vz. The fragments of the varistor Vz may be scattered to fall within the range AR of a conical space, which has the approximate center of the varistor Vz as the vertex P, a height in the positive X-axis direction (direction opposite to the predetermined direction), and the predetermined solid angle θ, in some cases. Thus, the common mode choke coil T1 is arranged so as to cover the whole area of the base of the conical shape with the approximate center of the varistor Vz as the vertex P and having the height in the positive X-axis direction and the predetermined solid angle θ.

A positional relationship between the common mode choke coil T1 and the varistor Vz is now described. Coordinates of the center of the varistor Vz on the X axis, the Y axis, and the Z axis are represented as Lx_vz, Ly_vz, and Lz_vz. A distance between the common mode choke coil T1 and the center of the varistor Vz is represented as Lx_t1. A coordinate of a right end of the common mode choke coil T1 in the Y-axis direction (upper end of the common mode choke coil T1 on the Y coordinate) is represented as Ly_t1*t*, and a coordinate of a left end of the common mode choke coil T1 in the Y-axis direction (lower end of the common mode choke coil T1 on the Y coordinate) is represented as Ly_t1*b*. A coordinate of an upper end of the common mode choke coil T1 in the Z-axis direction (upper end of the common mode choke coil T1 on the Z coordinate) is represented as Lz_t1*t*, and a coordinate of a lower end of the common mode choke coil T1 in the Z-axis direction (lower end of the common mode choke coil T1 on the Z coordinate) is represented as Lz_t1*b*. The common mode choke coil T1 has a columnar shape. The coordinate Ly_t1*t* of the right end, the coordinate Ly_t1*b* of the left end, and the coordinate Lz_t1*t* of the upper end, and the coordinate Lz_t1*b* of the lower end of the common mode choke coil T1 represent a size of the selected part. For example, the size of the selected part, the Y-axis coordinate Ly_vz and the Z-axis coordinate Lz_vz of the center of the varistor Vz, and the distance Lx_t1 between the common mode choke coil T1 and the center of the varistor Vz are set so as to satisfy the following relationships.

$$Ly_vz+Lx_t1\times\tan(\theta/2)<Ly_t1t$$

$$Ly_vz-Lx_t1\times\tan(\theta/2)>Ly_t1B$$

$$Lz_vz+Lx_t1\times\tan(\theta/2)<Lz_t1b$$

$$Lz_vz-Lx_t1\times\tan(\theta/2)>Lz_t1b$$

When the above-mentioned relationships are satisfied, the common mode choke coil T1 can cover the whole surface of the range AR having the conical shape with the solid angle θ, in which the fragments of the varistor Vz may be scattered. The second embodiment is achieved in consideration of the possibility of scattering of the fragments of the varistor Vz through an extremely small gap that is unintentionally formed at the joint portion between the exteriors of the image forming apparatus 100. According to the second embodiment, when the varistor Vz fails, the scattering of fragments of the varistor Vz to the outside through the extremely small gap unintentionally formed between the exteriors of the image forming apparatus 100 can be prevented without increasing the size of the image forming apparatus 100.

In the second embodiment, the whole surface of the solid angle θ, in which the fragments of the varistor Vz may be scattered, is covered with the common mode choke coil T1. The line filter may include the across-the-line capacitor C1, an across-the-line capacitor C2 (not shown), and the common mode choke coil T1. The across-the-line capacitor C1, the varistor Vz, the across-the-line capacitor C2 (not shown), and the common mode choke coil T1 may be arranged in the stated order in a downward direction from the AC input portion 501. In this case, the whole surface of the solid angle θ, in which the fragments of the varistor Vz may be scattered, may be covered with the across-the-line capacitor C2 (not shown). In this case also, when the varistor Vz fails, the scattering of fragments of the varistor Vz to the outside through the extremely small gap unintentionally formed between the exteriors of the image forming apparatus 100 can be prevented without increasing the size of the image forming apparatus 100.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-182032, filed Sep. 27, 2018, which is hereby incorporated by reference herein in its entirety.

What is claimed is:

1. An electrical equipment comprising:
an exterior having an opening portion;
a circuit board provided to an inside of the exterior and configured to be connected to a commercial power source;
a varistor mounted on the circuit board; and
a line filter mounted on the circuit board,
wherein the opening portion is formed in a predetermined direction orthogonal to electrodes of the varistor, and
wherein the line filter is arranged between the varistor and the opening portion in the predetermined direction so as to prevent a range of a conical shape having a vertex at a center of the varistor, a height in the predetermined direction, and a predetermined solid angle θ from intersecting with the opening portion.

2. The electrical equipment according to claim 1, wherein the opening portion is an air path for allowing air to flow between the inside and an outside of the exterior.

3. The electrical equipment according to claim 1, wherein the line filter is a capacitor or a common mode choke coil.

4. The electrical equipment according to claim 1, wherein the predetermined solid angle θ is equal to or smaller than 120 degrees.

5. The electrical equipment according to claim 1, further comprising another line filter to be mounted on the circuit board so as to cover a whole area of a base of a conical shape having a vertex at the center of the varistor, a height in a direction opposite to the predetermined direction, and the predetermined solid angle θ.

6. The electrical equipment according to claim 1, wherein the electrical equipment comprises an image forming apparatus configured to form an image on a recording medium, and
wherein the circuit board comprises a power supply circuit board configured to supply power to a load of the image forming apparatus.

7. The electrical equipment according to claim 6, wherein the load is a fixing device configured to fix the image formed on the recording medium.

8. An electrical equipment comprising:
an exterior having an opening portion;
a circuit board provided to an inside of the exterior and configured to be connected to a commercial power source;
a varistor mounted on the circuit board; and
a line filter mounted on the circuit board,
wherein the opening portion is formed in a predetermined direction orthogonal to electrodes of the varistor, and
wherein the line filter is arranged between the varistor and the opening portion in the predetermined direction so as to cover a whole area of a base of a conical shape having a vertex at a center of the varistor, a height in the predetermined direction, and a predetermined solid angle θ.

9. The electrical equipment according to claim 8, wherein the opening portion is an air path for allowing air to flow between the inside and an outside of the exterior.

10. The electrical equipment according to claim 8, wherein the line filter is a capacitor or a common mode choke coil.

11. The electrical equipment according to claim 8, wherein the predetermined solid angle θ is equal to or smaller than 120 degrees.

12. The electrical equipment according to claim 8, further comprising another line filter to be mounted on the circuit board so as to cover a whole area of a base of a conical shape having a vertex at the center of the varistor, a height in a direction opposite to the predetermined direction, and the predetermined solid angle θ.

13. The electrical equipment according to claim 8, wherein the electrical equipment comprises an image forming apparatus configured to form an image on a recording medium, and wherein the circuit board comprises a power supply circuit board configured to supply power to a load of the image forming apparatus.

14. The electrical equipment according to claim 13, wherein the load is a fixing device configured to fix the image formed on the recording medium.

* * * * *